US011515651B1

(12) United States Patent
Patriotis et al.

(10) Patent No.: US 11,515,651 B1
(45) Date of Patent: Nov. 29, 2022

(54) LOW LOSS TUNABLE MATCHING NETWORK FOR PATTERN RECONFIGURABLE ARRAY ANTENNAS

(71) Applicant: UNM Rainforest Innovations, Albuquerque, NM (US)

(72) Inventors: Marios Patriotis, Albuquerque, NM (US); Christos G. Christodoulou, Albuquerque, NM (US); Firas Nazem Ayoub, Albuquerque, NM (US)

(73) Assignee: UNM Rainforest Innovations, Albuquerque, NM (US)

( * ) Notice: Subject to any disclaimer, the term of this patent is extended or adjusted under 35 U.S.C. 154(b) by 0 days.

(21) Appl. No.: 17/341,160

(22) Filed: Jun. 7, 2021

Related U.S. Application Data

(60) Provisional application No. 63/035,501, filed on Jun. 5, 2020.

(51) Int. Cl.

| | |
|---|---|
| ***H01Q 21/26*** | (2006.01) |
| ***H01Q 21/28*** | (2006.01) |
| ***H01Q 3/24*** | (2006.01) |
| ***H01Q 5/335*** | (2015.01) |
| ***H01Q 11/14*** | (2006.01) |

(52) U.S. Cl.
CPC ..... *H01Q 21/26* (2013.01); *H01Q 3/247* (2013.01); *H01Q 5/335* (2015.01); *H01Q 11/14* (2013.01); *H01Q 21/28* (2013.01)

(58) Field of Classification Search
CPC ..... H01Q 21/26; H01Q 21/28; H01Q 3/247; H01Q 5/335; H01Q 11/14
See application file for complete search history.

(56) References Cited

U.S. PATENT DOCUMENTS

2014/0266962 A1* 9/2014 Dupuy ..... H03D 7/165 333/125

FOREIGN PATENT DOCUMENTS

WO WO-2020005231 A1 * 1/2020 ..... H03F 1/565

* cited by examiner

*Primary Examiner* — Hoang V Nguyen
(74) *Attorney, Agent, or Firm* — Keith Vogt, Ltd.; Keith A. Vogt

(57) ABSTRACT

An array antenna system having an RF-port with individually controlled radiating elements.

10 Claims, 12 Drawing Sheets

LOW LOSS TUNABLE MATCHING NETWORK FOR PATTERN RECONFIGURABLE ARRAY ANTENNAS

RELATED APPLICATIONS

This application claims priority to U.S. Provisional Application No. 63/035,501, filed on 2020 Jun. 5, which is incorporated herein in its entirety.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

Antennas that can adapt in a varying electromagnetic environment have drawn great attention in the growing era of 5G-network, CubeSats, and any other communication system that requires multiple established links. This antenna type has the beneficial ability to instantaneously alter its operating behavior (radiation pattern, frequency, polarization, space) to adjust in new electromagnetic behaviors.

In the case of an array antenna that requires pattern and space diversity for the signal to noise ratio and multipath effects improvement; the pattern and space traits are controlled. These are usually reconfigurable either by means of multiple expensive systems (transceivers) at each individual antenna element port, or by means of single to multiple port switch. In the first case, the issue appears at many expensive components needed for proper operation, while the second case can enable only one RF-port (antenna) at a time.

BRIEF SUMMARY OF THE INVENTION

In one embodiment, the present invention provides a cost-effective solution where the array antenna system has a single RF-port with individually controlled radiating elements. This is achieved with a reconfigurable matching network, used to create a multiport enabled switch that connects to each antenna.

In other embodiment, the present invention provides a reconfigurable matching network to tune an RF circuit at different input impedances. The network can be 1 to N (N=1, 2, 3 . . . ) port with an independent number of ports activated (N, N−1, N−2 . . . ), sharing equally, at any instance, the supplied power. The network remains balanced during the ports' activation due to the reconfigurable tuning stubs and the stack topology design with uniform sections.

In other embodiment, the present invention provides a cube antenna with circular polarization. The embodiment exploits the switch to cover the Φ-plane in four 90°-degree sectors with sixteen alternative patterns provided by four reconfigurable ports, $2^N$ (N=4).

In other embodiment, the present invention provides an array antenna system having a single RF-port with individually controlled radiating elements which is achieved with a reconfigurable matching network, used to create a multiport enabled switch that connects to each antenna.

In other embodiment, the present invention provides a system, method, and device comprising a reconfigurable matching network to tune an RF circuit at different input impedances.

In other embodiment, the present invention provides a system, method, and device wherein the network remains balanced during the ports' activation due to the reconfigurable tuning stubs and the stack topology design with uniform sections.

In other embodiment, the present invention provides a system, method, and device wherein a cube antenna with circular polarization exploits the switch to cover the Φ-plane in four 90°-degree sectors with sixteen alternative patterns provided by four reconfigurable ports, $2^N$ (N=4).

In other embodiment, the present invention provides a system, method, and device comprising a reconfigurable tuning network used to create an independent-port RF switch that maintains good input matching during the alternative ports' activation.

In other embodiment, the present invention provides a system, method, and device wherein the tuning network has stack topology that allows symmetrical surface currents resulting in balanced matching for all the possible switching combinations.

In other embodiment, the present invention provides a system, method, and device wherein matching is achieved using stubs, where the reconfigurable stubs/reactance to match a variety of input impedances.

In other embodiment, the present invention provides a system, method, and device wherein each of the loads is reconfigurable by extending themselves using more active elements and stubs.

In other embodiment, the present invention provides a system, method, and device wherein the active elements can be any RF switch type, preferably of the type that introduces the least electromagnetic turbulence during the installation.

In other embodiment, the present invention provides a reconfigurable tuning networks wherein the signal is transmitted through a via, which may be copper, to the bottom switching port system, which may be uniform in construction.

In other embodiment, the present invention provides a reconfigurable tuning network wherein the system consists of uniform arms, each incorporating an RF switch to activate or deactivate the port that the signal is desired to reach.

In other embodiment, the present invention provides a reconfigurable tuning network having a reconfigurable independent active-port switch that can be used to form single RF-port array antennas, able to activate and deactivate radiating elements.

In other embodiment, the present invention provides a reconfigurable tuning network having a reconfigurable independent active-port switch that can be used to form single RF-port array antennas, able to activate and deactivate radiating elements and the active and passive components can be implemented at the output ports of the suggested 1 to N RF switch, forming a phased array antenna without the necessary implementation of transceivers to control individually each radiating element.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings generally illustrate, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure, or system. Further, the terms and phrases used herein are not intended to be limiting, but rather to provide an understandable description of the invention.

Figure 1A:
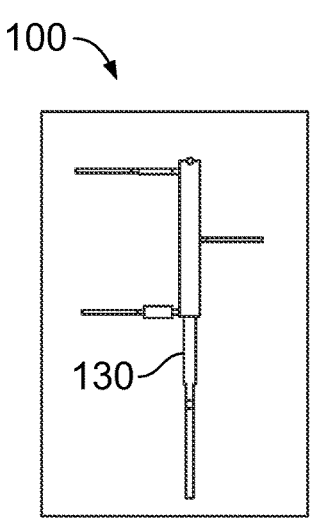
FIG. 1A is a top view of a reconfigurable tuning switch topology for an embodiment of the present invention.
Figure 1B:
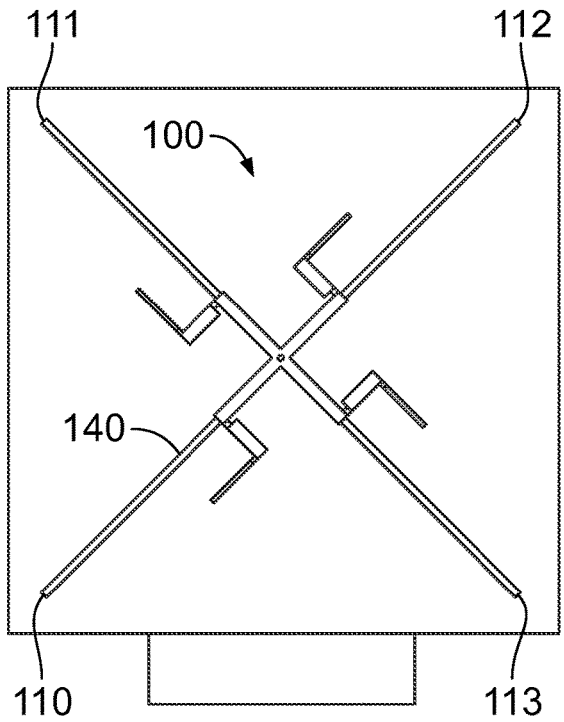
FIG. 1B is a bottom view of a reconfigurable tuning switch topology for an embodiment of the present invention.
Figure 1C:
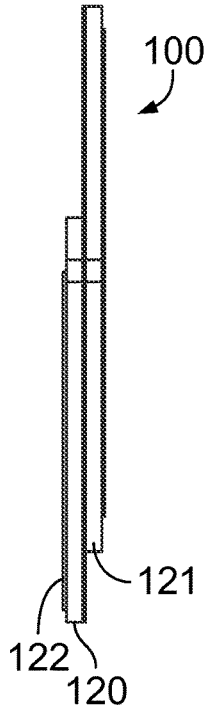
FIG. 1C is a side view of a reconfigurable tuning switch topology for an embodiment of the present invention.

In a preferred embodiment, the present invention provides a reconfigurable tuning network 100 used to create an independent-port RF switch that maintains input matching during an alternative ports' activation, as seen in FIGS. 1A-1C. The embodiment shown uses as an example four ports 110-113 and consequently, fifteen ($2^4-1$) matched switching states (excluding the OFF state). Also, the operating center frequency chosen for the example design is 10 GHz; nevertheless, the embodiments of the present invention may apply at any desired frequency.

The tuning network of the present invention has stack topology that allows symmetrical surface currents resulting in balanced matching for all the possible switching combinations. In this case, it consists of two same 0.25 mm thick substrates 120 and 121 (RT6006, $\varepsilon_r$=6.15, tan $\delta$=0.0019) sharing a common ground plane 122. The first substrate 120 accommodates the reconfigurable matching network 130 shown in FIG. 1A, and the second substrate 121 has the switchable ports network 140, as shown in FIG. 1B. An exemplary configuration is illustrated in FIG. 1C, explained from top to bottom as follows.

Figure 2:
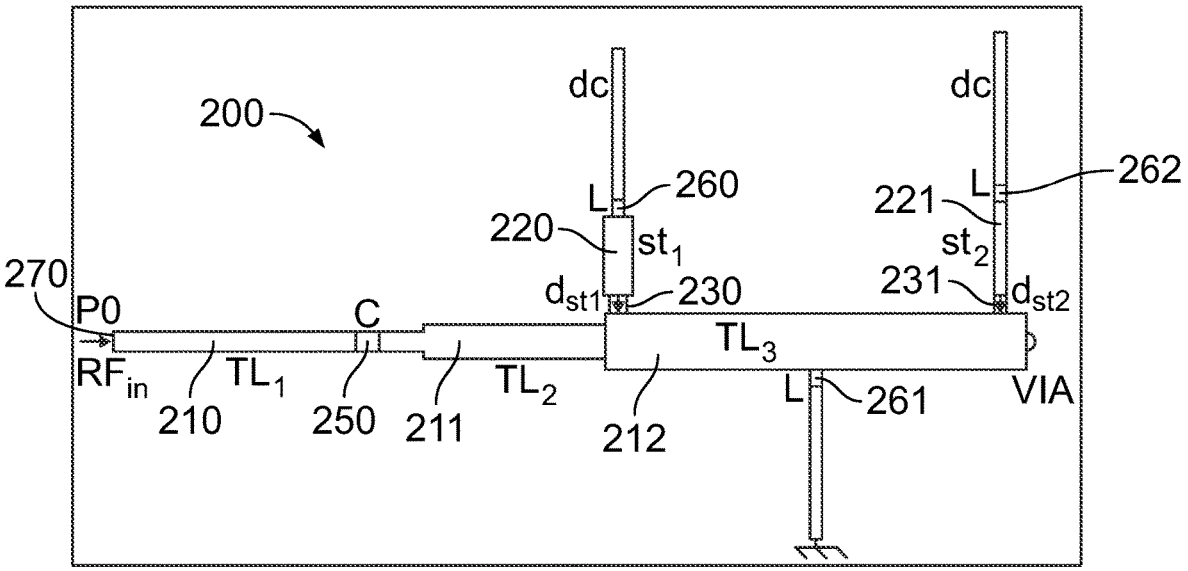
FIG. 2 illustrates a reconfigurable matching network for an embodiment of the present invention.

The reconfigurable matching network 200 located on the top substrate 120 as shown in FIG. 2, is composed of three transmission lines 210-212; components of the shelf at 10 GHz, a capacitor 250, inductors 260-262

Initially, the signal path starts at the P0 port 270 at the 50 Ohm line $TL_1$ (210). The line extends to a 0.8 pF capacitor 250, serving as DC-block, protecting the RF source. The $\lambda_g/4$-line TL2 (211) serves as an inductance transformer, at 35.35 Ohm, matches the 50 Ohm line TL1 (210) to the 25 Ohm line TL3 (212). This line has the two PIN diodes 230, 231 assembled on it, and an inductor 261 of 3.8 nH, as part of the DC-bias network.

Figure 3:
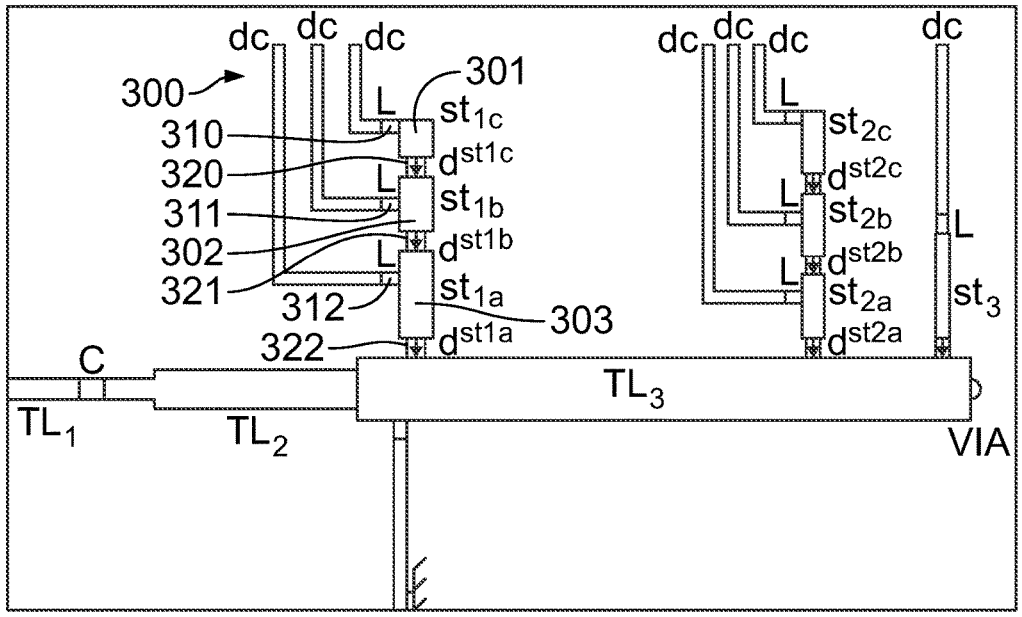
FIG. 3 illustrates an alternative possible reconfigurable matching network for an embodiment of the present invention.

The inductors allow the proper DC-circuit formation for the diodes' activation; diodes in turn are responsible for the reconfigurable stub integration in the switching network. The length of line TL3 (212) depends on the diodes integrated position. This position relies on the changeable input impedance at the point of VIA each time a new port is activated in the bottom layer. In other words, the matching happens using stubs, where the approach is the reconfigurable stubs/reactance to match a variety of input impedances. This approach is not limited just to the specific stub shown herein, but each of the stub can be reconfigurable too, by extending themselves using more active elements (320-322) and stubs (301-303) as FIG. 3 shows.

Additionally, the active elements can be any RF switch type (PIN diode, RF MEMS, Varactor, etc. . . . ), preferable the ones introduce the least electromagnetic turbulence during the installation. This is the key for stable tuning performance and the realization of numerous reconfigurable stubs.

Figure 4:
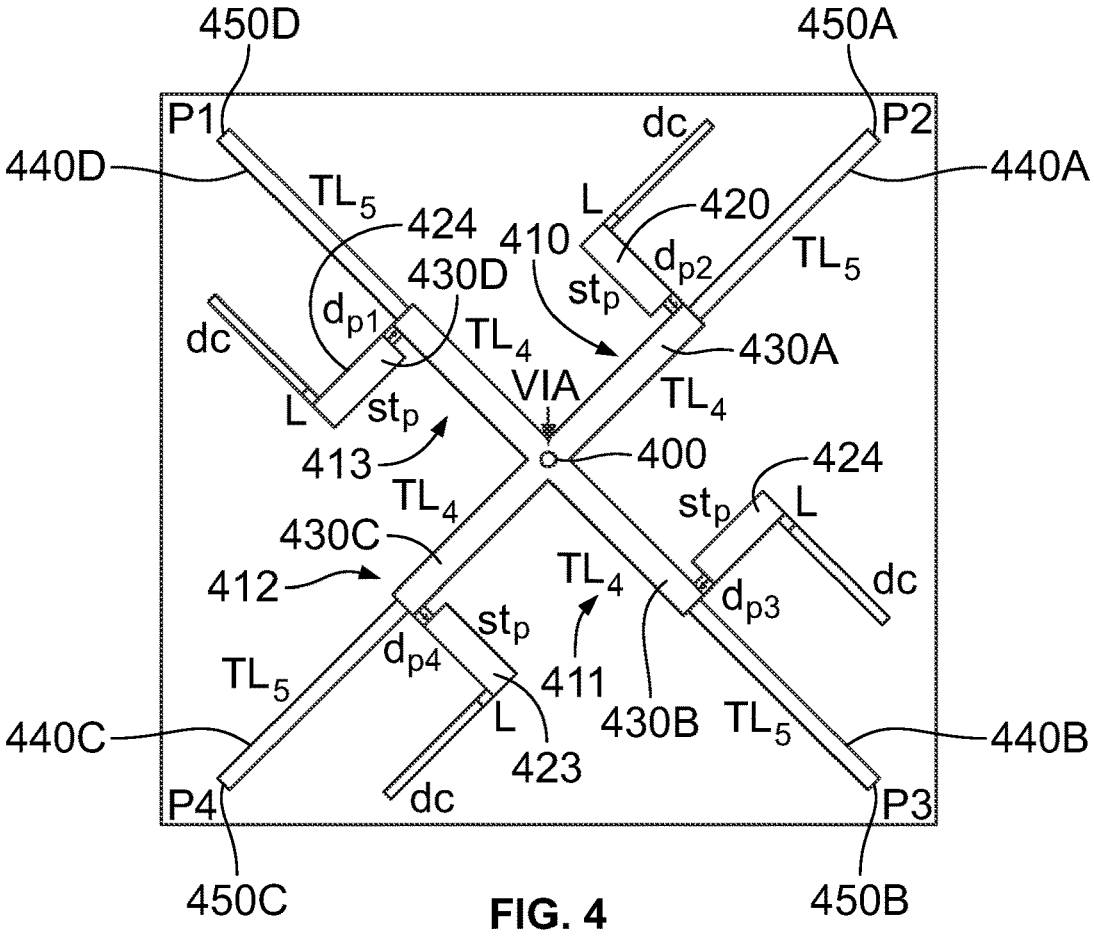
FIG. 4 illustrates a reconfigurable switching network for an embodiment of the present invention.

Afterwards, the signal is transmitted through via 400 which may be a copper rod of 1.5 mm radius to the bottom uniform switching port system as shown in FIG. 4. This system consists of arms 410-413, which may be uniform in construction. For this particular exemplar, each of them is composed of a 35.35 Ohm transmission line TL4 (430A-430D) connected to a reconfigurable shunt stub stp (420-423) and a 50 Ohm transmission line TL5 (440A-440D), that ends to a 50 Ohm RF port Pn (450A-450D).

The transmission line TL4 (430A-430D) serves to impedance match the previous line TL3 to the next line TL5. At the end section of TL4, the reconfigurable shunt stub is implemented to serve as an enabled RF choke to allow or block the power to be distributed to the RF port. In this case, as shown for arm 410 as the exemplar, each reconfigurable shunt stub 420 is comprised of a dc line 462, an inductor 463, and a diode dpn 464. The other arms of the system are similarly configured.

The state (ON/OFF) of the diode activates or deactivates respectively the RF choke into the arm. When the diode is on, the RF choke function is active and no RF reaches the port. When the diode is off, RF reaches the port.

The RF choke may be also achieved with a series configuration by having an RF switch to connect the two transmission lines TL4 and TL5, implemented at a distance that creates a virtual open load at the OFF state of the switch.

Figure 5:
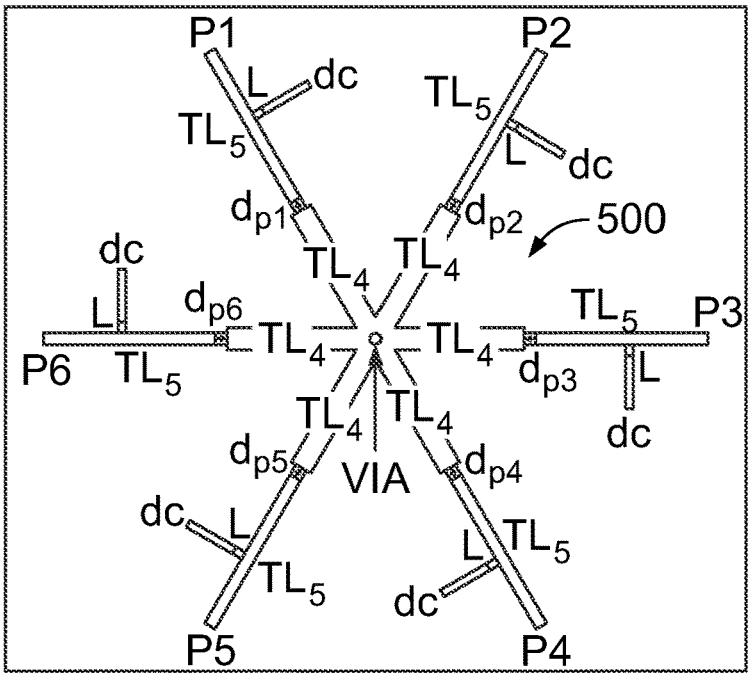
FIG. 5 illustrates an alternative possible reconfigurable switching network for an embodiment of the present invention.
Figure 6A:
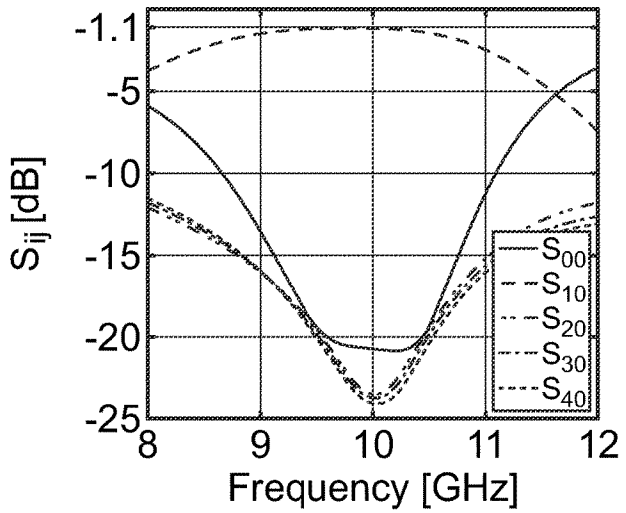
FIG. 6A shows S-parameters of the reconfigurable switching network for an embodiment of the present invention with 1 port enabled.
Figure 6B:
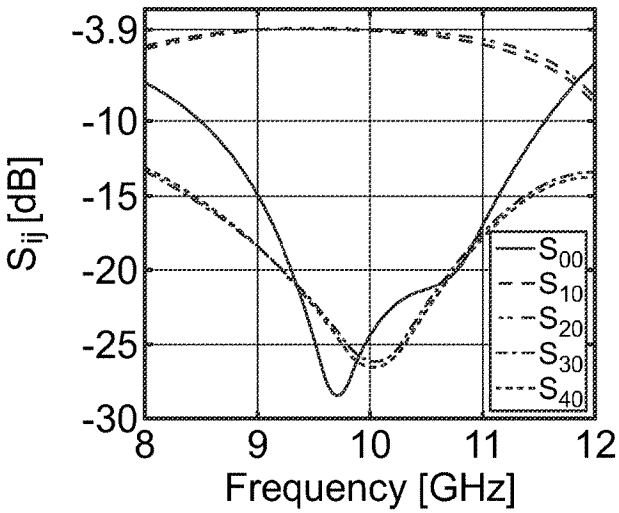
FIG. 6B shows S-parameters of the reconfigurable switching network for an embodiment of the present invention with 2 ports enabled.
Figure 6C:
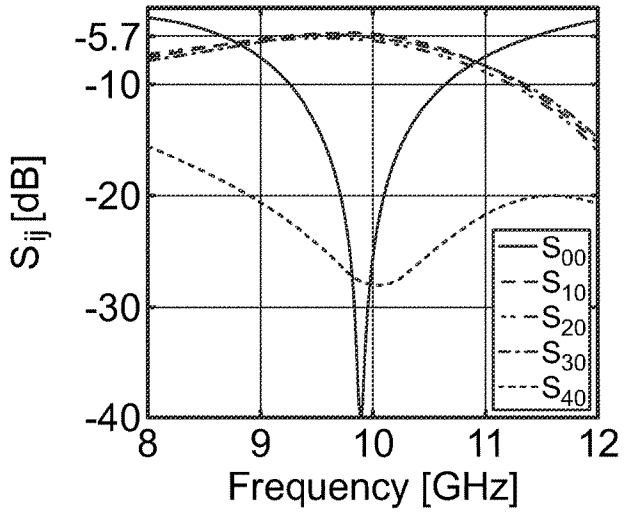
FIG. 6C shows S-parameters of the reconfigurable switching network for an embodiment of the present invention with 3 ports enabled.
Figure 6D:
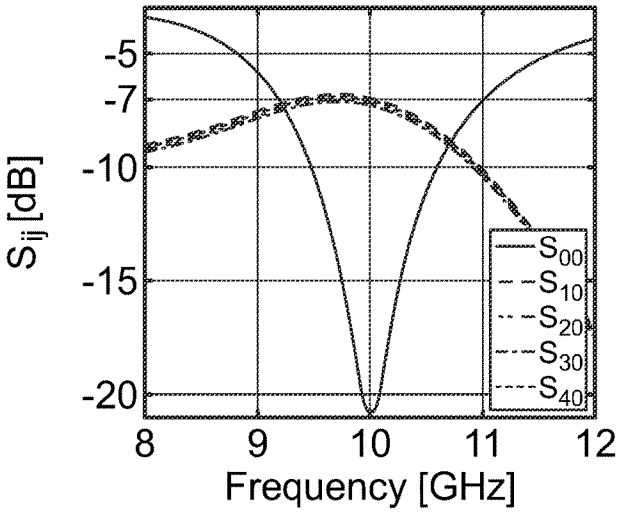
FIG. 6D shows S-parameters of the reconfigurable switching network for an embodiment of the present invention with 4 ports enabled.
Figure 7A:
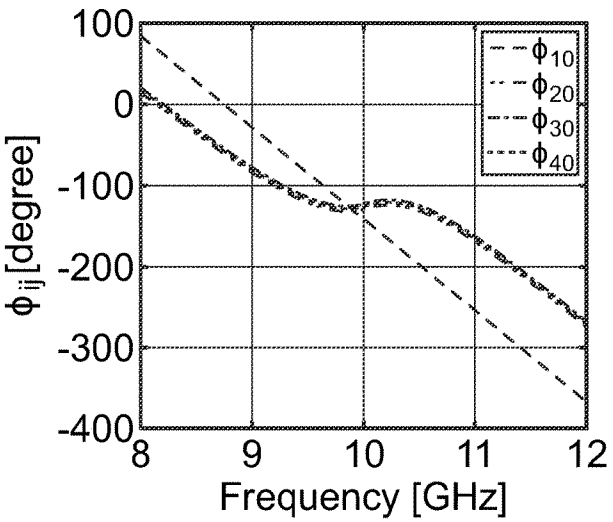
FIG. 7A shows a port's phase of the reconfigurable switching network for an embodiment of the present invention with 1 port enabled.
Figure 7B:
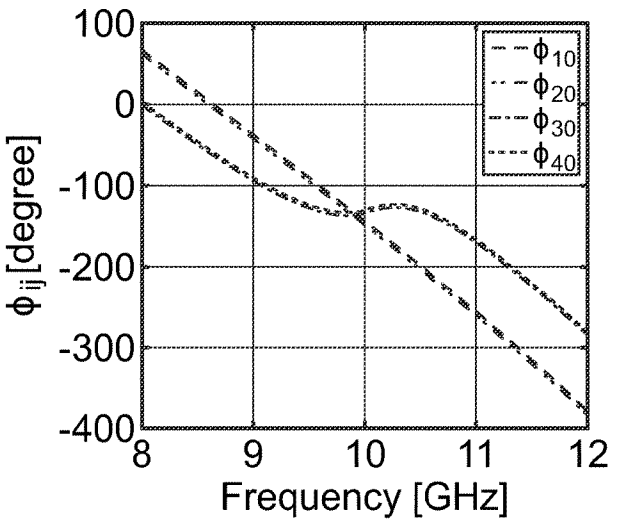
FIG. 7B shows a port's phase of the reconfigurable switching network for an embodiment of the present invention with 2 ports enabled.
Figure 7C:
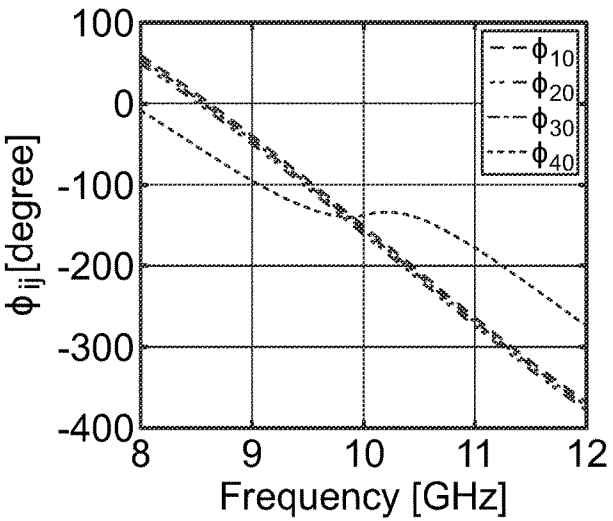
FIG. 7C shows a port's phase of the reconfigurable switching network for an embodiment of the present invention with 3 ports enabled.
Figure 7D:
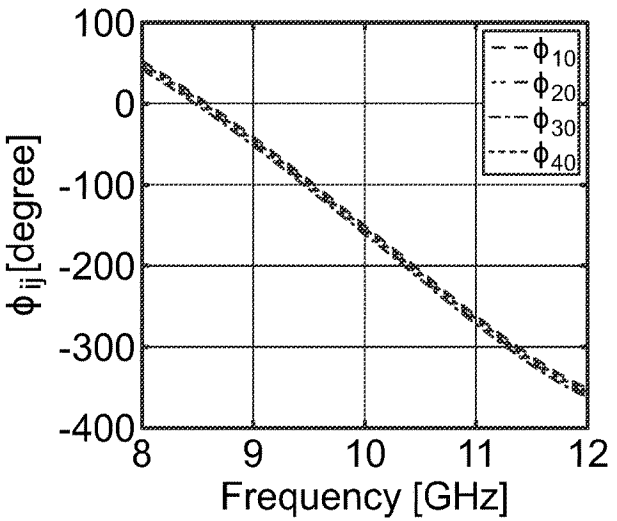
FIG. 7D shows a port's phase of the reconfigurable switching network for an embodiment of the present invention with 4 ports enabled.

The choice between the two configurations of implementing the RF choke, series or shunt, depends on the active element characteristics, such as insertion loss and isolation at the ON and OFF states respectively. If more ports are requested, these are included maintaining the uniform system pattern 500 as shown in FIG. 5, with the addition of the proper reconfigurable matching stubs at the top network.

The circuitry's reconfigurable condition for proper operation is provided in Table 1, showing the necessary diodes' state, OFF or ON, in respective binary form 0 or 1. As shown, all ports can be enabled alone or in combination with other ports, by activating the associate tuning stub. For instance, if two ports are desired to be enabled, tuning stub St2 is active to set this condition.

In case one port is enabled, then it receives all the supplied power RFin from the P0 port; if more than one port is enabled, the supplied power is equally shared among them in the same phase, while maintaining input matching. The simulated (in HFSS) reflection coefficient and signal phase at each port, are depicted in FIGS. 6 and 7, respectively. The two figures illustrate four cases: plot (a) includes one port enabled; plot (b) has two ports enabled; plot (c) has three ports enabled; plot (d) has four ports enabled. Individual combinations of each port for the above cases are not shown because the electromagnetic response remains the same thanks to the uniform pattern of the network. For instance, in the case of two-port enabled, the individual combination 0011 ($P_4P_3P_2P_1$) has a similar response (s-parameters—magnitude and phase) with 0110 or 1100 or 1001 or 1010 or 0101. As seen in the S-parameter figure (FIG. 6), the circuitry has an input reflection coefficient always less than −20 dB with isolation towards the disabled ports to exceed 24 dB. The insertion loss is noticed to be almost 1 dB in each case due to non-ideal active elements implemented in the system and the dielectric losses. Specifically, the transmission coefficient (TC) for each case at center frequency Fc=10 GHz is as next: for single port enabled is −1.1 dB (ideal 0 dB); for two ports enabled, TC is −3.9 dB (ideal −3 dB); for three ports enabled, TC is −5.7 dB (ideal −4.7 dB); for four ports enabled, TC is −7 dB (ideal −6 dB).

TABLE 1

| $St_2$ | $St_1$ | $P_4$ | $P_3$ | $P_2$ | $P_1$ |
|---|---|---|---|---|---|
| 0 | 0 | 0 | 0 | 0 | 1 |
| 0 | 0 | 0 | 0 | 1 | 0 |
| 1 | 0 | 0 | 0 | 1 | 1 |
| 0 | 0 | 0 | 1 | 0 | 0 |
| 1 | 0 | 0 | 1 | 0 | 1 |

TABLE 1-continued

| $St_2$ | $St_1$ | $P_4$ | $P_3$ | $P_2$ | $P_1$ |
|---|---|---|---|---|---|
| 1 | 0 | 0 | 1 | 1 | 0 |
| 0 | 1 | 0 | 1 | 1 | I |
| 0 | 0 | 1 | 0 | 0 | 0 |
| 1 | 0 | 1 | 0 | 0 | 1 |
| 1 | 0 | 1 | 0 | 1 | 0 |
| 0 | 1 | 1 | 0 | 1 | 1 |
| 1 | 0 | 1 | 1 | 0 | 0 |
| 0 | I | 1 | 1 | 0 | 1 |
| 0 | 1 | 1 | 1 | 1 | 0 |
| 0 | 1 | 1 | 1 | 1 | 1 |

The electromagnetic balanced behavior of the system is seen in FIGS. 6 and 7, where the graphs representing the enabled ports are identical. Similarly, the disabled ports have identical response with each other too. Therefore, the designed reconfigurable independent active-port switch can be used to form single RF-port array antennas, able to activate and deactivate radiating elements. Moreover, active and passive components such as power amplifiers, RF switches, phase shifters, attenuators, couplers, etc., can be implemented at the output ports of the suggested 1 to N RF switch, forming for instance a phased array antenna without the necessary implementation of transceivers to control individually each radiating element.

Figure 8A:
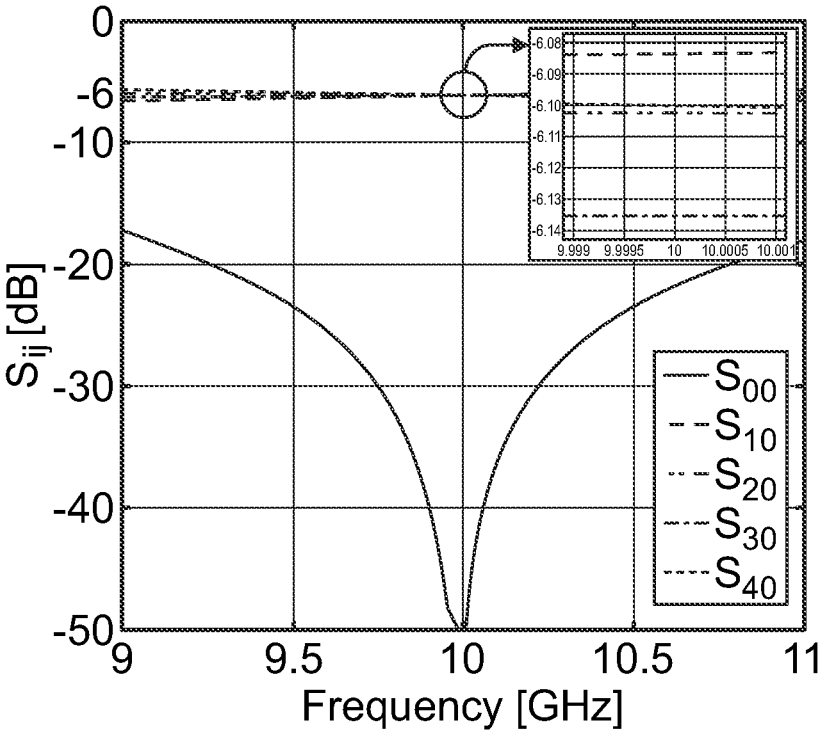
FIG. 8A is a top view of a cube antenna implementing a reconfigurable tuning switch network for an embodiment of the present invention.
Figure 8B:
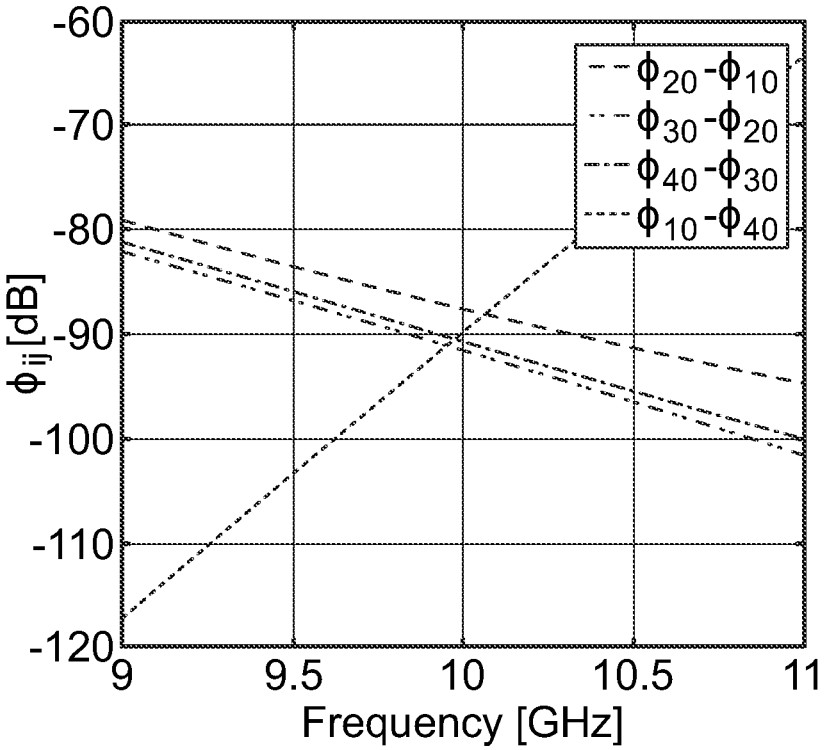
FIG. 8B is a bottom view of a cube antenna implementing a reconfigurable tuning switch network for an embodiment of the present invention.

As shown in FIGS. 8A and 8B, cube antenna array 800 is able to cover four 90° degree sectors 810-813. FIG. 8A shows the arrange of the sectors. Each sector of the antenna consists of four planar arrays 910-913 enclosing the reconfigurable feeding network to compose a concise device, covering an area of 27 mm×27 mm×27 mm.

Figure 9A:
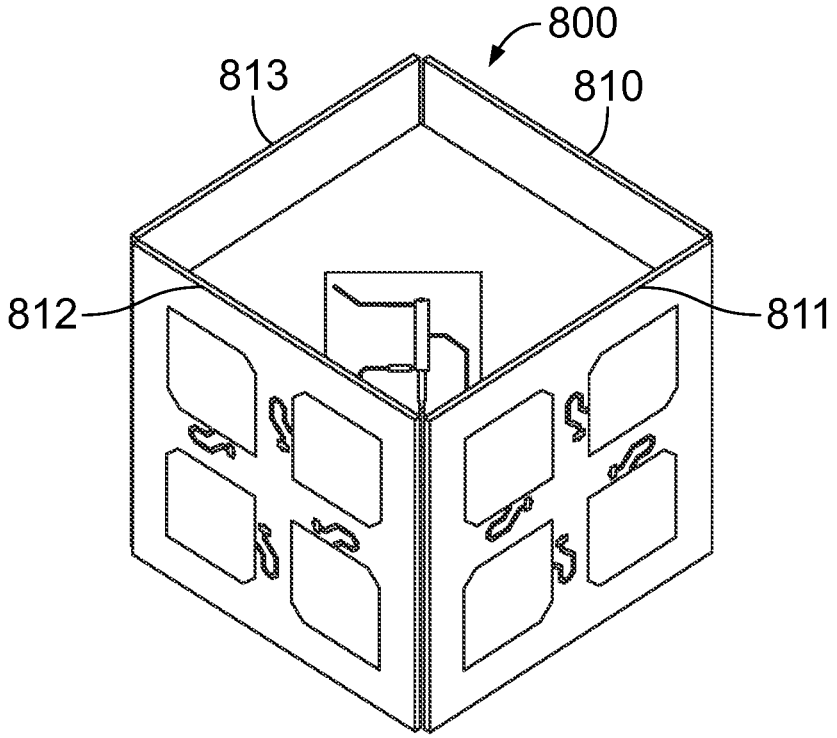
FIG. 9A is a top view of a planar array antenna for an embodiment of the present invention.
Figure 9B:
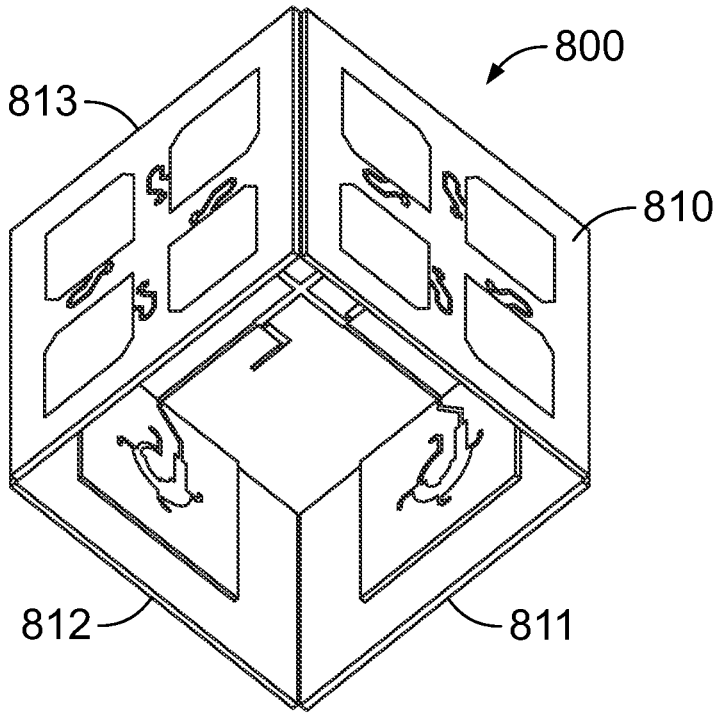
FIG. 9B is a bottom view of a planar array antenna for an embodiment of the present invention.

The switching ports described previously are now extended to the feeding port of the four planar arrays that are aligned orthogonally with each other to form the cube. Each planar array has a stack topology with the radiating elements located at the top layer 900 (a 0.5 mm thick RO3003 substrate, $\varepsilon_r$=3, tan δ=0.0013) and the feeding network 921 located at the bottom layer 920 (a 0.25 mm thick RT6006 substrate), separated by a common ground 930 to improve isolation, as seen in FIG. 9B.

Figure 10A:
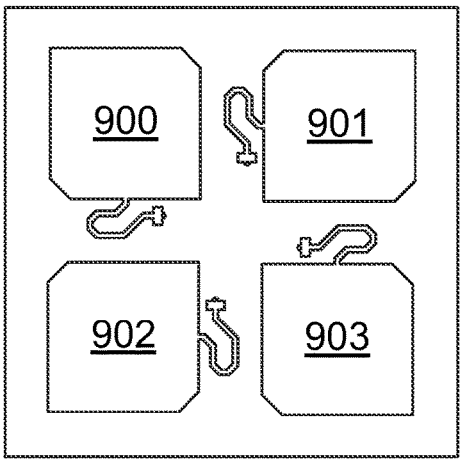
FIG. 10A illustrates S-parameters response for a sequential power divider for an embodiment of the present invention.
Figure 10B:
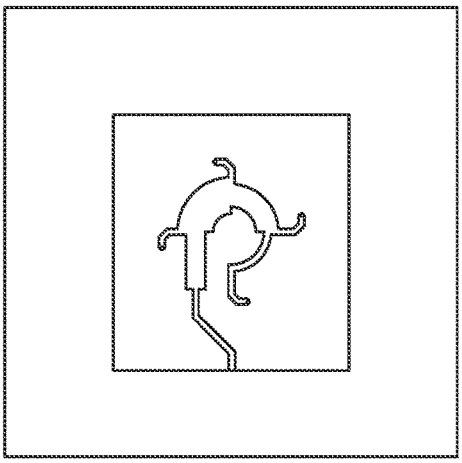
FIG. 10B illustrates consecutive phase difference response for a sequential power divider for an embodiment of the present invention.
Figure 11A:
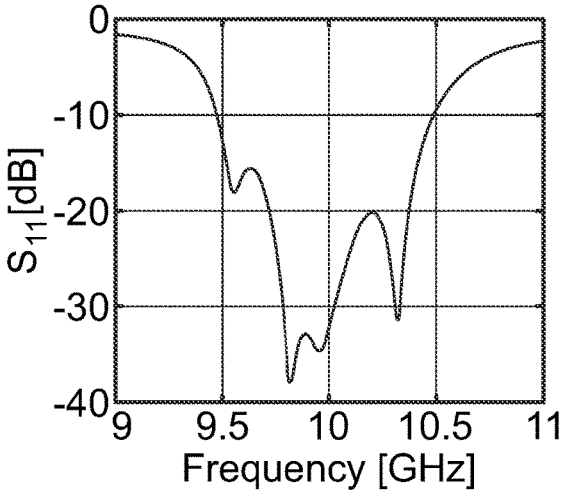
FIG. 11A shows a planar array's response and the input reflection coefficient for an embodiment of the present invention.
Figure 11B:
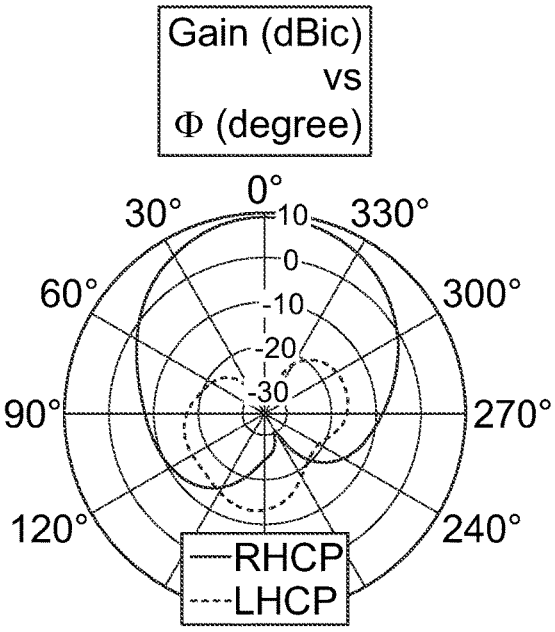
FIG. 11B shows a planar array's response and the gain at plane $\Theta=90°$ degrees for an embodiment of the present invention.
Figure 12A:
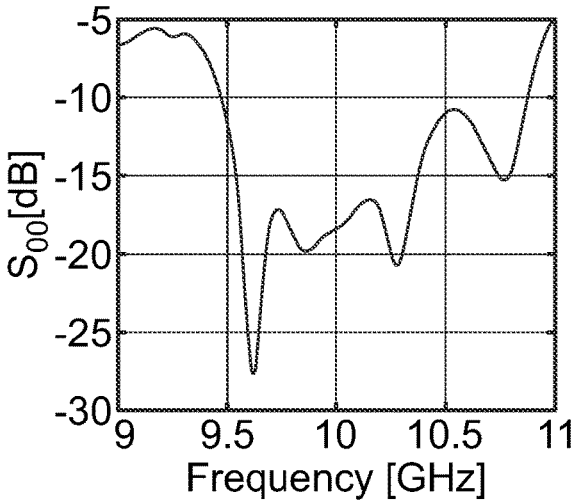
FIG. 12A shows a cube antenna system reflection coefficient for an embodiment of the present invention with 1 port enabled.
Figure 12B:
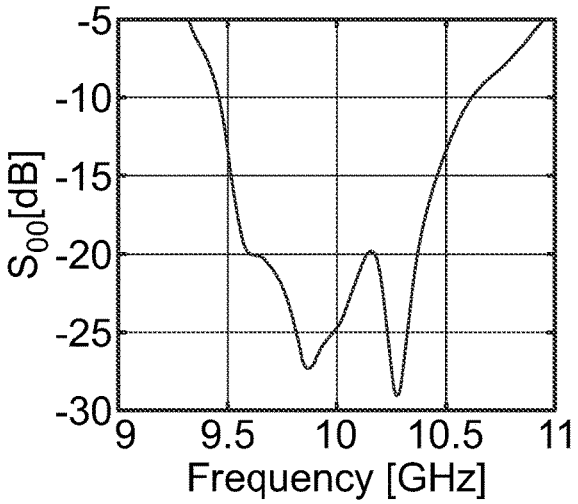
FIG. 12B shows a cube antenna system reflection coefficient for an embodiment of the present invention with 2 ports enabled.
Figure 12C:
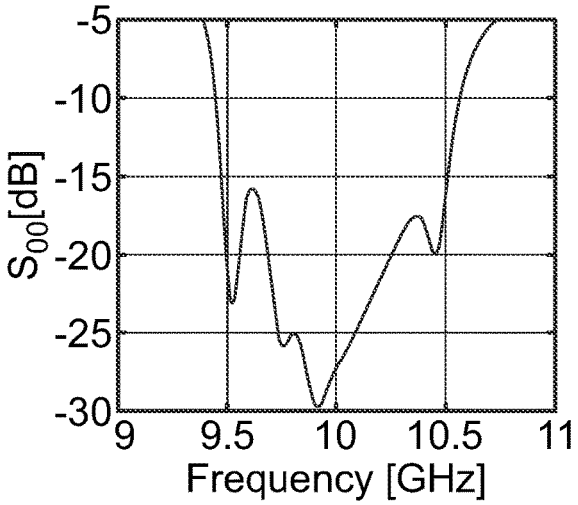
FIG. 12C shows a cube antenna system reflection coefficient for an embodiment of the present invention with 3 ports enabled.
Figure 12D:
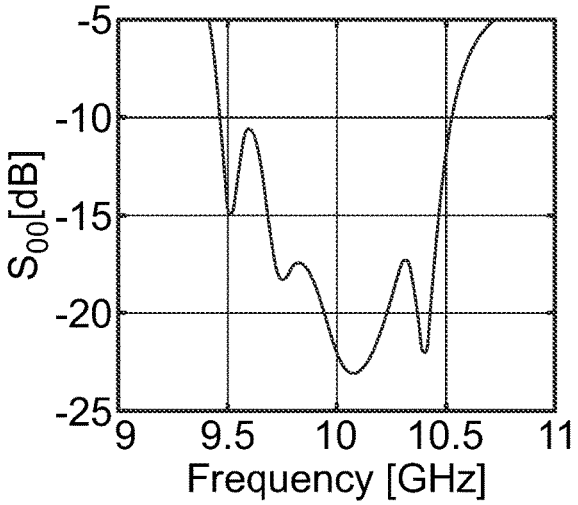
FIG. 12D shows a cube antenna system reflection coefficient for an embodiment of the present invention with 4 ports enabled.
Figure 13A:
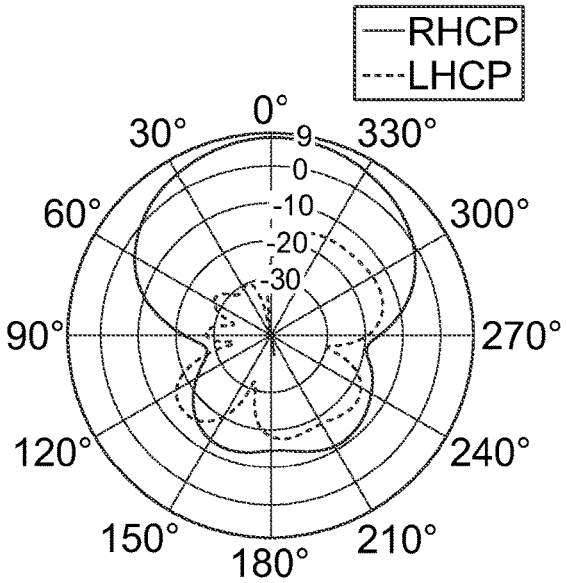
FIG. 13A shows a cube antenna system radiation pattern when 1 port enabled for an embodiment of the present invention with port 1 enabled.
Figure 13B:
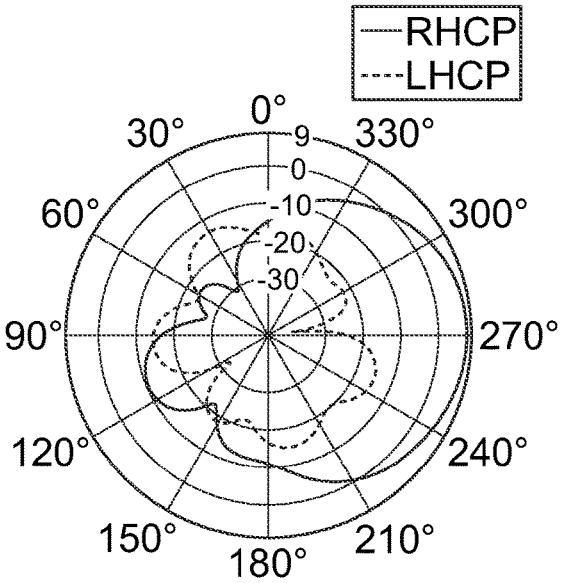
FIG. 13B shows a cube antenna system radiation pattern when 1 port enabled for an embodiment of the present invention with port 2 enabled.
Figure 13C:
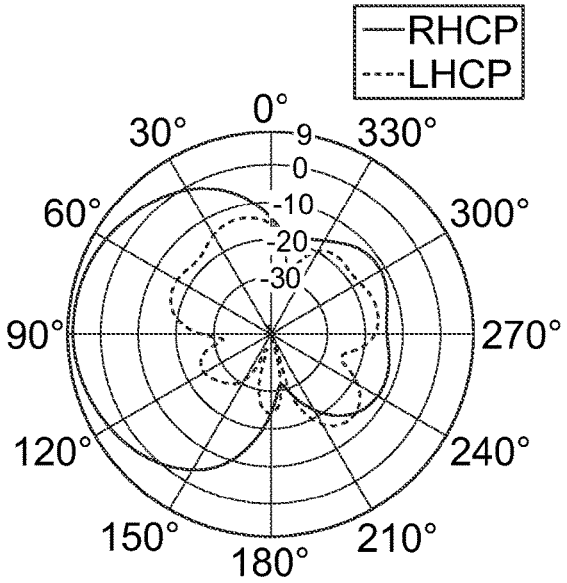
FIG. 13C shows a cube antenna system radiation pattern when 1 port enabled for an embodiment of the present invention with port 3 enabled.
Figure 13D:
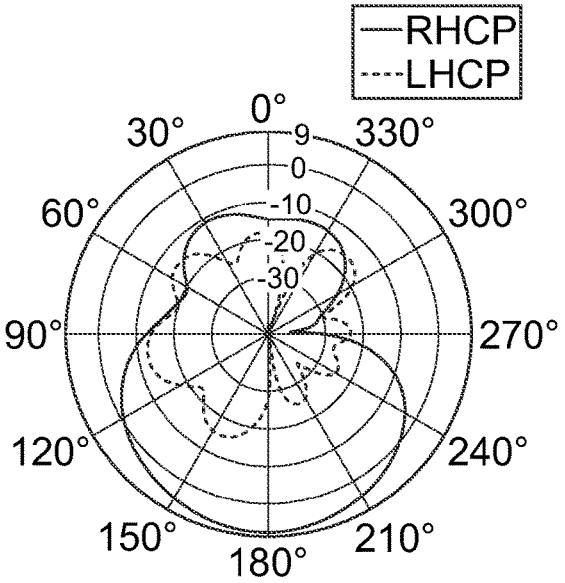
FIG. 13D shows a cube antenna system radiation pattern when 1 port enabled for an embodiment of the present invention with port 4 enabled.
Figure 14A:
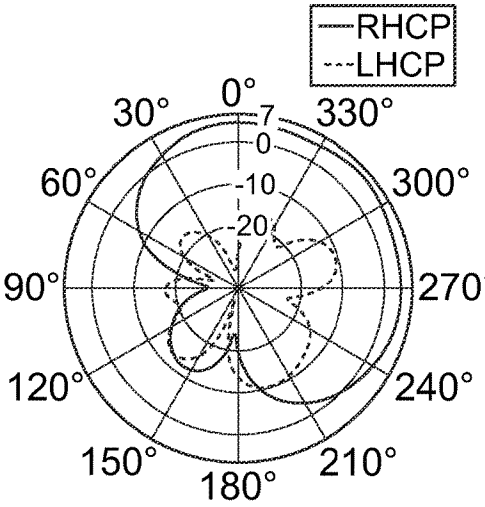
FIG. 14A shows a cube antenna system radiation pattern when 2 ports enabled for an embodiment of the present invention with port 1 and port 2 enabled.
Figure 14B:
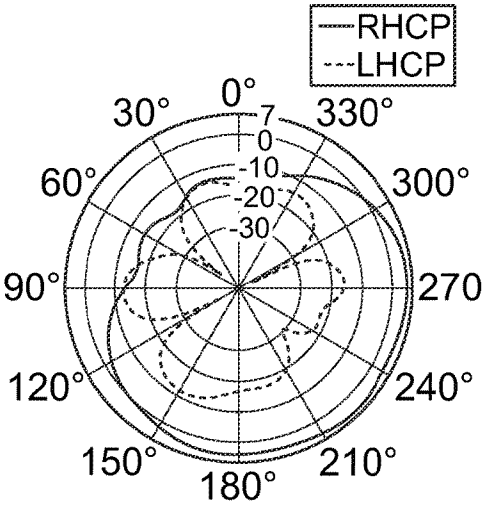
FIG. 14B shows a cube antenna system radiation pattern when 2 ports enabled for an embodiment of the present invention with port 2 and port 3 enabled.
Figure 14E:
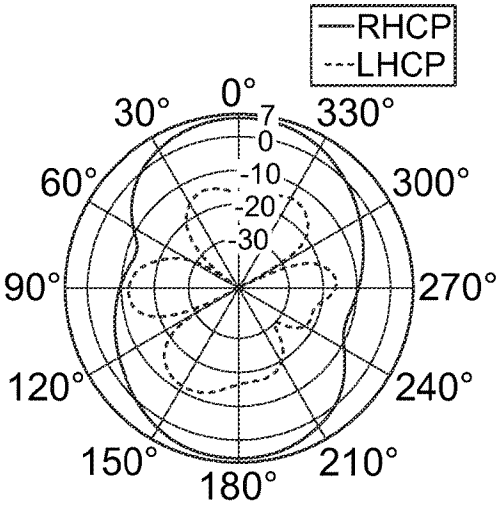
FIG. 14E shows a cube antenna system radiation pattern when 2 ports enabled for an embodiment of the present invention with port 1 and port 3 enabled.
Figure 14C:
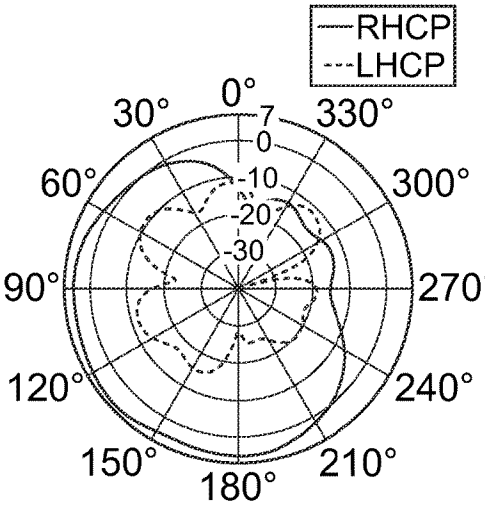
FIG. 14C shows a cube antenna system radiation pattern when 2 ports enabled for an embodiment of the present invention with port 3 and port 4 enabled.
Figure 14D:
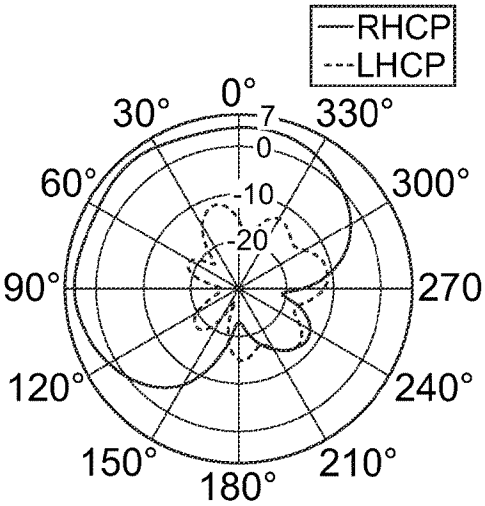
FIG. 14D shows a cube antenna system radiation pattern when 2 ports enabled for an embodiment of the present invention with port 4 and port 1 enabled.
Figure 14F:
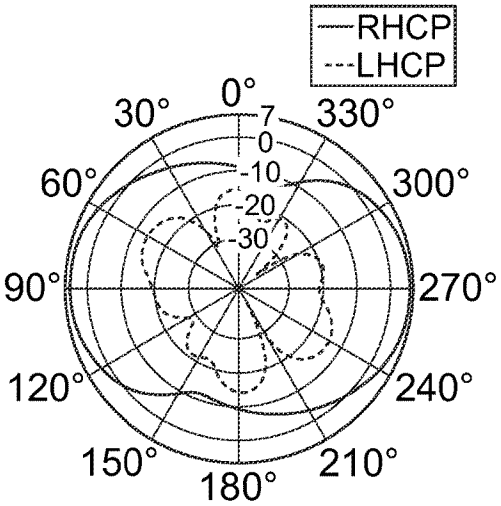
FIG. 14F shows a cube antenna system radiation pattern when 2 ports enabled for an embodiment of the present invention with port 2 and port 4 enabled.
Figure 15A:
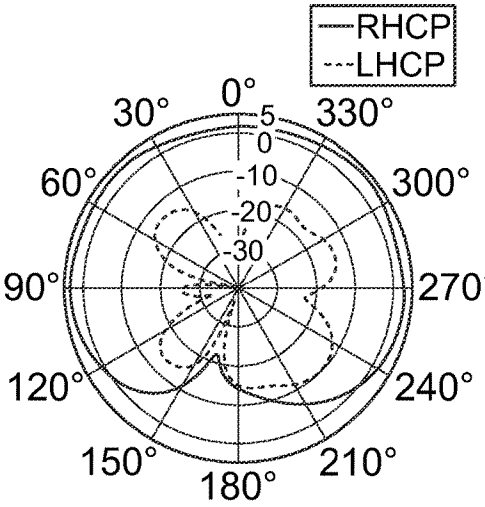
FIG. 15A shows a cube antenna system radiation pattern when 3 ports enabled for an embodiment of the present invention with port 1, port 2, and port 3 enabled.
Figure 15B:
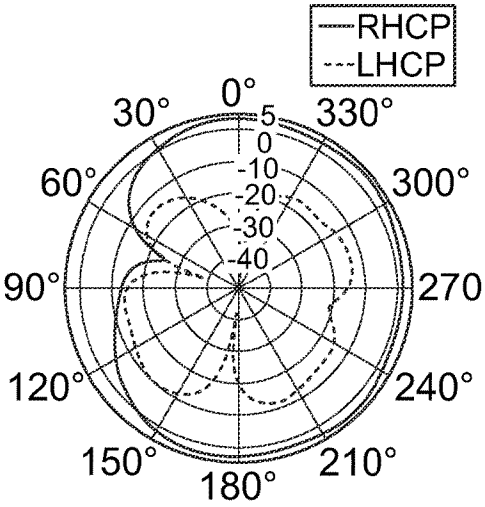
FIG. 15B shows a cube antenna system radiation pattern when 3 ports enabled for an embodiment of the present invention with port 2, port 3, and port 4 enabled.
Figure 15E:
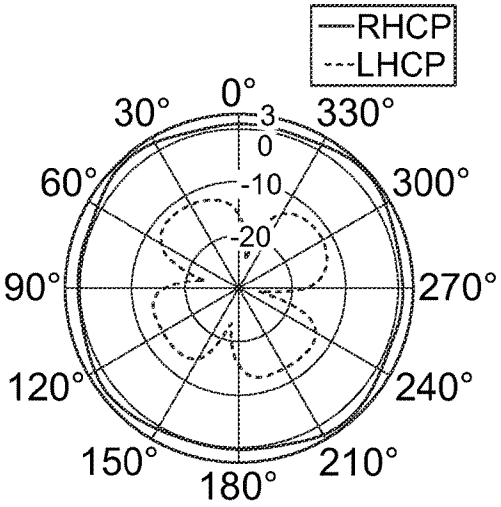
FIG. 15E shows a cube antenna system radiation pattern when 4 ports enabled for an embodiment of the present invention with port 1, port 2, port 3, and port 4 enabled.
Figure 15C:
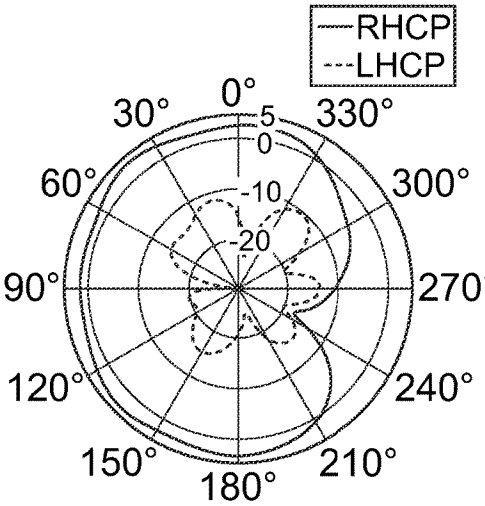
FIG. 15C shows a cube antenna system radiation pattern when 3 ports enabled for an embodiment of the present invention with port 3, port 4, and port 1 enabled.
Figure 15D:
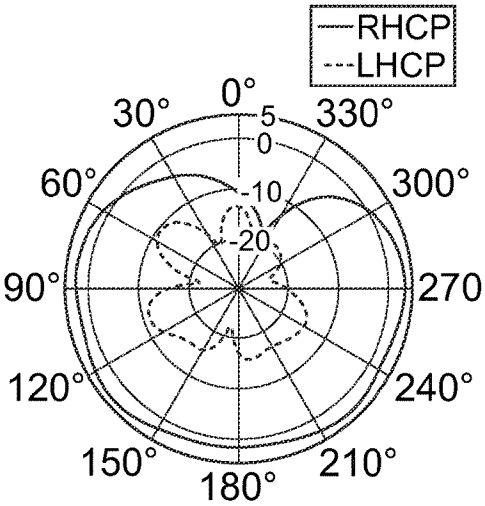
FIG. 15D shows a cube antenna system radiation pattern when 3 ports enabled for an embodiment of the present invention with port 4, port 1, and port 2 enabled.

The radiating elements that compose the array are rectangular truncated patches aligned sequentially and fed through VIAs (copper rods) by a sequentially rotated power divider. The divider delivers equal power in a consecutive phase difference (90° degrees at Fc=10 GHz) between the elements, as seen in FIGS. 10A and 10B. The performance of the planar array alone is depicted in FIGS. 11A and 11B, with an input reflection coefficient better than −30 dB and a RHCP realized gain to reach 9 dBic at the Fc; cross-polarization (LHCP) is −30 dB.

The unique performance that the reconfigurable switching system provides to an antenna application is shown in FIGS. 12-15. The reflection coefficient of the cube antenna in FIG. 12, proves the good operating frequency range (9.5-10.5 GHz) for the four enabled port cases. The radiation pattern of the fifteen alternative cases is shown in FIGS. 13-15, demonstrating the beam diversity of the antenna that covers the four 90°-degree sectors. The figures include the co and cross-polarization gain, where the 3 dB beamwidth coverage is 61° degrees (FIG. 13) for one port enabled; 150° (FIG. 14) for two-port enabled; 245.5° degrees for three ports enabled and 360° degrees for four ports enabled (FIG. 15).

Inexpensive and simple antennas like the present invention with independent multiple beam steering are novel designs thanks to the newly introduced mechanism they are driven by. Similarly, the reconfigurable tuning network can be used to approach different reconfigurable antenna models such as polarization diverse, frequency diverse, or a combination of other radiating characteristics.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiments, methods, and examples, but by all embodiments and methods within the scope and spirit of the disclosure. In addition, to the above description, the materials attached hereto form part of the disclosure of this provisional patent application.

What is claimed is:

1. An array antenna system comprising:

a reconfigurable matching network connected to a multiport switch by a via;

said reconfigurable matching network comprised of a port connected to an initial transmission line, said initial transmission line including a capacitor;

an intermediate transmission line connected to said initial transmission line, said intermediate transmission line functions as an inductance transformer;

a terminal transmission line connected to said intermediate transmission line on one end and a via on another end;

a plurality of stubs, each of said plurality of stubs connected to said terminal transmission line by a diode;

said diodes located between said ends of said terminal transmission line;

each of said stubs connected to a DC line by an inductor;

said multiport switch comprised of a plurality of arms, one end of said arms connected to said via and the other ends connected to a port;

an RF choke connected to each of said arms, said RF choke turns power on and off at said port; and a plurality of antenna arrays, each array connected to a port of said arms.

2. The array of claim 1 wherein said stubs are the same.

3. The array of claim 2 wherein said arms are uniform.

4. The array of claim 3 wherein said stubs of said reconfigurable matching network change the impedance at said via.

5. The array of claim 4 wherein said RF chokes are comprised of a stub connected to said arm by a diode, said stubs connected to a DC line by an inductor.

6. The array of claim 5 wherein, when one port is enabled, it receives all the supplied power and, if more than one port is enabled, the supplied power is equally shared among them in the same phase, while maintaining input matching.

7. The array of claim 5 wherein said reconfigurable matching network is configured to tune an RF circuit at different input impedances.

8. The array of claim 4 wherein said RF chokes are comprised of a plurality of stub sets, each set comprised of a plurality stubs connected by diodes and wherein at least one stub of each set is connected to said arm by a diode, said stubs connected to a DC line by an inductor.

9. The array of claim 3 wherein said RF chokes are comprised of an RF switch.

10. The reconfigurable tuning network of claim 1 wherein said ports are configured to activate and deactivate radiating elements.

* * * * *